US009046811B2

(12) United States Patent
Kato

(10) Patent No.: US 9,046,811 B2
(45) Date of Patent: Jun. 2, 2015

(54) DEVELOPING DEVICE

(71) Applicant: Atsushi Kato, Ichinomiya (JP)

(72) Inventor: Atsushi Kato, Ichinomiya (JP)

(73) Assignee: Brother Kogyo Kabushiki Kaisha, Nagoya-shi. Aichi-ken (JP)

( * ) Notice: Subject to any disclaimer, the term of this patent is extended or adjusted under 35 U.S.C. 154(b) by 104 days.

(21) Appl. No.: 13/779,808

(22) Filed: Feb. 28, 2013

(65) Prior Publication Data

US 2013/0223889 A1 Aug. 29, 2013

(30) Foreign Application Priority Data

Feb. 29, 2012 (JP) ..... 2012-042644

(51) Int. Cl.
*G03G 15/08* (2006.01)

(52) U.S. Cl.
CPC ..... *G03G 15/08* (2013.01); *G03G 15/0889* (2013.01)

(58) Field of Classification Search
CPC ..... G03G 15/0889; G03G 15/08
USPC ..... 399/254, 260
See application file for complete search history.

(56) References Cited

U.S. PATENT DOCUMENTS

| | | | |
|---|---|---|---|
| 5,539,502 | A | 7/1996 | Koshino et al. |
| 7,800,437 | B2 | 9/2010 | Khoury et al. |
| 2008/0247784 | A1 | 10/2008 | Kakuta et al. |
| 2011/0076062 | A1 | 3/2011 | Kakuta et al. |
| 2011/0103844 | A1 | 5/2011 | Sato |
| 2012/0170955 | A1 | 7/2012 | Kakuta et al. |
| 2013/0136507 | A1* | 5/2013 | Kato ..... 399/281 |

FOREIGN PATENT DOCUMENTS

| | | | |
|---|---|---|---|
| JP | 06-301284 | A | 10/1994 |
| JP | 07-333913 | A | 12/1995 |
| JP | 08-123180 | A | 5/1996 |

(Continued)

OTHER PUBLICATIONS

Machine translation of Adachi et al., JP 2008-176015.*

(Continued)

*Primary Examiner* — David Gray
*Assistant Examiner* — Sevan A Aydin
(74) *Attorney, Agent, or Firm* — Banner & Witcoff, Ltd.

(57) ABSTRACT

A developing device includes: a developing chamber provided with a developing agent-holding body; a first developing agent-accommodating chamber for accommodating a developing agent and arranged below the developing chamber; a first rotating member disposed in the first developing agent-accommodating chamber, elastically deformable and configured to rotate to slidably contact with an inner surface of the first developing agent-accommodating chamber; a second developing agent-accommodating chamber arranged adjacent to the developing chamber and an upper portion of the first developing agent-accommodating chamber, and to which the developing agent in the first developing agent-accommodating chamber is supplied by the first rotating member; and a second rotating member disposed in the second developing agent-accommodating chamber, elastically deformable and configured to rotate to slidably contact with an inner surface of the second developing agent-accommodating chamber and to transport the developing agent in the second developing agent-accommodating chamber toward the developing chamber.

20 Claims, 5 Drawing Sheets

(56) References Cited

FOREIGN PATENT DOCUMENTS

| | | | | |
|---|---|---|---|---|
| JP | 08-160749 | A | | 6/1996 |
| JP | 2008-170951 | A | | 7/2008 |
| JP | 2008176015 | A | * | 7/2008 |
| JP | 2008-250290 | A | | 10/2008 |
| JP | 2011-095578 | A | | 5/2011 |
| JP | 2013037343 | A | * | 2/2013 |

OTHER PUBLICATIONS

Machine translation of Senda et al., JP 2013-037343.*

* cited by examiner

DEVELOPING DEVICE

CROSS REFERENCE TO RELATED APPLICATION

The present application claims priority from Japanese Patent Application No. 2012-042644 filed on Feb. 29, 2012 the disclosure of which is incorporated herein by reference in its entirety.

BACKGROUND OF THE INVENTION

1. Field of the Invention

The present invention relates to a developing device provided with a developing agent-accommodating chamber.

2. Description of the Related Art

Conventionally, there is known a developing device, of an image forming apparatus, wherein a developing roller which holds the developing agent and a supply roller which supplies the developing agent are disposed in a developing chamber; and a developing agent-accommodating chamber which accommodates the developing agent is arranged or located at a position below the developing chamber.

In such a developing device, an elastic transporting member, which also functions also as an agitator agitating the developing agent inside the developing agent-accommodating chamber, rotates so as to slidably contact with the inner surface of the developing agent-accommodating chamber, to thereby transport the developing agent from the developing agent-accommodating chamber which is arranged below to the developing chamber which is arranged above.

SUMMARY OF THE INVENTION

According to the above-described technique, however, it is necessary to transport the developing agent to the developing chamber from the developing agent-accommodating chamber against the gravity, and thus excessive burden is exerted on the transporting member, which in turn degrades the transporting member. This lowers the transporting performance of the transporting member, thereby causing such a problem that the developing agent cannot be stably supplied to the developing chamber.

In view of the above situation, an object of the present teaching is to provide a developing device which is capable of supplying the developing agent stably to the developing chamber in a case that the developing-agent accommodating chamber is arranged at a position below the developing chamber.

According to a first aspect of the present teaching, there is provided a developing device including: a developing chamber provided with a developing agent-holding body configured to hold a developing agent; a first developing agent-accommodating chamber configured to accommodate the developing agent and arranged at a position below the developing chamber; a first rotating member disposed in the first developing agent-accommodating chamber, elastically deformable, and configured to rotate so as to slidably contact with an inner surface of the first developing agent-accommodating chamber; a second developing agent-accommodating chamber which is arranged adjacent to the developing chamber and adjacent to an upper portion of the first developing agent-accommodating chamber, and to which the developing agent in the first developing agent-accommodating chamber is supplied by rotation of the first rotating member; and a second rotating member disposed in the second developing agent-accommodating chamber, elastically deformable, and configured to rotate so as to slidably contact with an inner surface of the second developing agent-accommodating chamber and to transport the developing agent in the second developing agent-accommodating chamber toward the developing chamber.

According to a second aspect of the present teaching, there is provided a developing device including: a developing agent-holding body configured to hold a developing agent; a housing provided with: a developing chamber configured to accommodate the developing agent-holding body; a first developing agent-accommodating chamber configured to accommodate the developing agent and arranged at a position below the developing chamber; and a second developing agent-accommodating chamber which is arranged adjacent to the developing chamber and adjacent to an upper portion of the first developing agent-accommodating chamber; a first rotating member which is elastically deformable and configured to rotate so as to slidably contact with an inner surface of the first developing agent-accommodating chamber and to supply the developing agent to the second developing agent-accommodating chamber; and a second rotating member which is elastically deformable and configured to rotate so as to slidably contact with an inner surface of the second developing agent-accommodating chamber and to transport the developing agent in the second developing agent-accommodating chamber toward the developing chamber.

According to the above configurations, the second developing agent-accommodating chamber is provided separately from the first developing agent-accommodating chamber, and thus the transporting performance of each of the first and second rotating members may be made to be small, thereby making it possible to lower the burden while transporting the developing agent. Owing to this configuration, it is possible to suppress the degradation of the first and second rotating members, and to supply a predetermined amount of the developing agent to the developing chamber stably.

DESCRIPTION OF THE PREFERRED EMBODIMENTS

Figure 1:
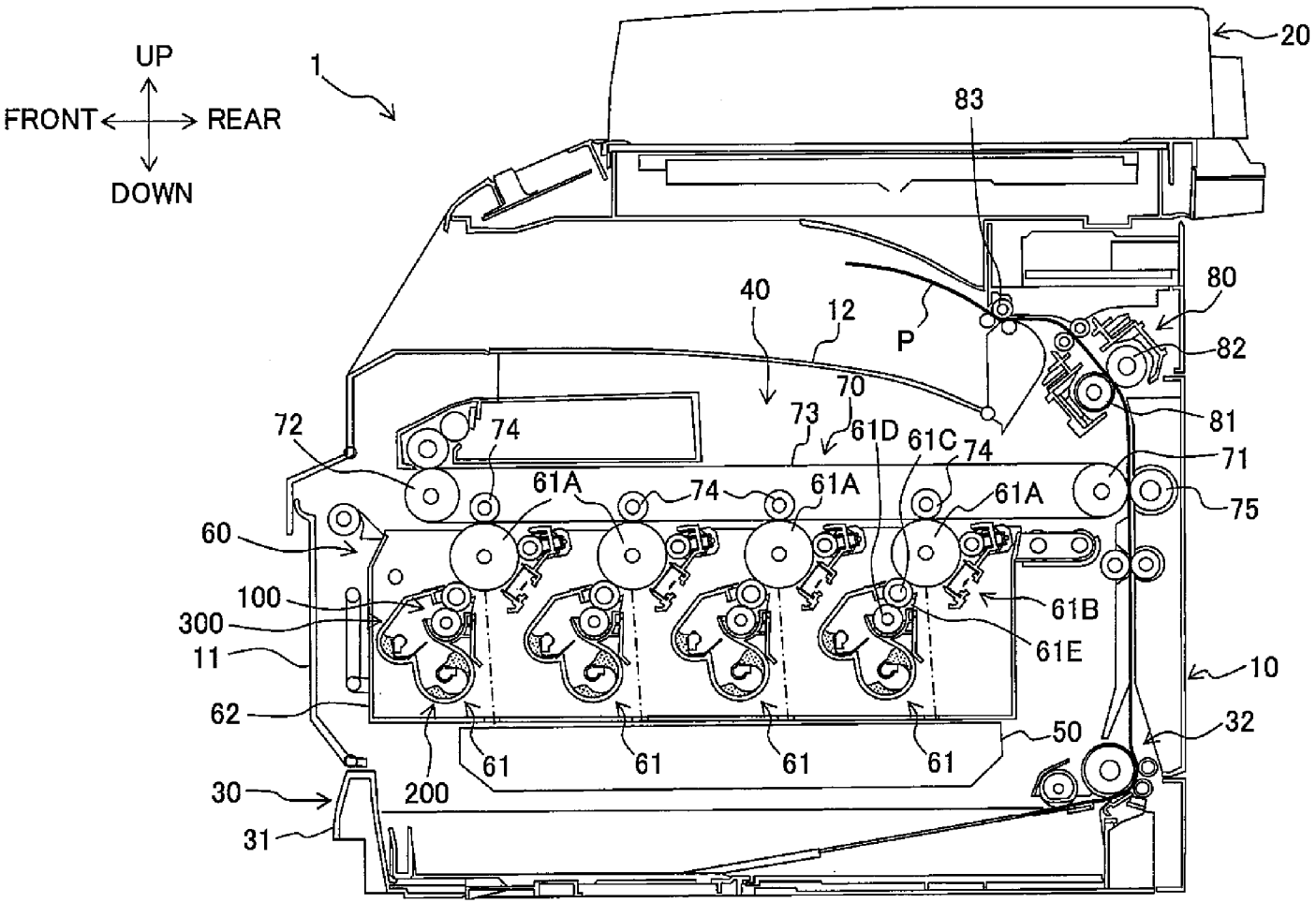
FIG. 1 is a schematic diagram showing the configuration of a color multi-functioned machine as an example of an image forming apparatus provided with a developing device of the present teaching.

Next, an explanation will be given about an embodiment of the present teaching with reference to the drawings as appropriate. Note that in the following, the schematic configuration of a color multi-functioned machine 1 as an example of an image forming apparatus provided with a developing device according to the embodiment will be firstly explained, and then the configuration characteristic to the present teaching will be explained. Further, in the following explanation, directions are explained with a user using the color multi-functioned machine 1 as the reference. Namely, the left side and right side in FIG. 1 are "front" and "rear", respectively, and the front side and the rear side in FIG. 1 (frontward side and the other side with respect to the sheet surface of FIG. 1) are "left" and "right", respectively. Further, the upper side and lower side in FIG. 1 are "up" and "down", respectively.

Schematic Configuration of Color Multi-Functioned Machine

As shown in FIG. 1, the color multi-functioned machine 1 is provided with a body housing 10 and a flat bed scanner 20. Further, the color multi-functioned machine 1 mainly has, inside the body housing 10, a paper feeding section 30 which supplies paper (paper sheet) P and an image forming section 40 which forms an image, etc. on the supplied paper P.

The flat bed scanner 20 is a publicly known manuscript (original) reading device which is provided at a position above the body housing 10. When performing copying, etc., the flat bed scanner 20 irradiates light onto an original set in the flat bed scanner 20 and generates an image data by reading an image drawn in the original.

The paper feeding section 30 is arranged in the body housing 10 at a lower portion of the body housing 10 and is mainly provided with a paper feed tray 31 in which the paper P is accommodated, and a paper feed mechanism 32 which transports the paper P from the paper feed tray 31 to the image forming section 40. A plurality of sheets of the paper P in the paper feed tray 31 are separated one by one by the paper feed mechanism 32 and are transported to the image forming section 40.

The image forming section 40 is mainly constructed of an exposing section 50, a processing section 60, a transferring section 70 and a fixing section 80.

The exposing section 50 is arranged at a position above the paper feeding section 30, and is provided with un-illustrated laser light source, polygon mirror, lens, reflecting mirror, etc. Laser light (laser light beam) emitted from the laser light source is reflected by the polygon mirror, reflecting mirror, etc., passes through the lens and is subjected to a high-speed scanning on a surface of each of photosensitive drums (photoconductive drums) 61A of the processing section 60.

The processing section 60 is arranged at a position above the exposing section 50, and is mainly provided with four pieces of a process cartridge 61, as an example of the developing device, which are aligned in the front/rear direction, and a holding case 62 which holds the process cartridges 61.

Figure 2:
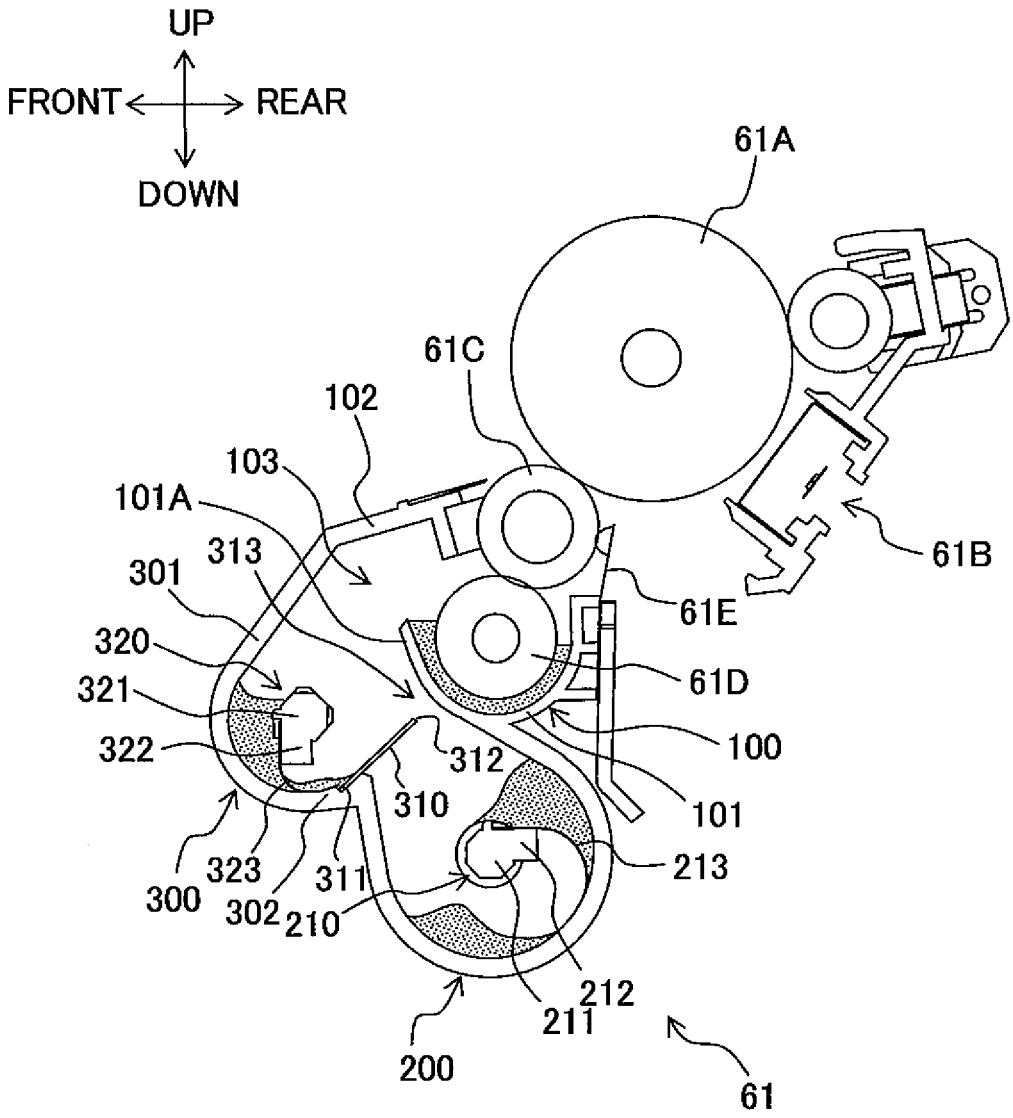
FIG. 2 is an enlarged view showing those in the vicinity of the developing device.

As shown in FIG. 2, each of the process cartridges 61 is provided with a photoconductive drum 61A, an electric charger 61B, a developing roller 61C as an example of the developing agent-holding body, a supplying roller 61D and a layer-thickness regulating blade 61E.

The photoconductive drum 61A is constructed of a conductive, circular-cylinder shaped drum body, and a photoconductive layer formed on a surface of the drum body. The electric charger 61B is a member which uniformly charges the surface of the photoconductive drum 61A, and is arranged to face (be opposite to) the photoconductive drum 61A at a position away from the photoconductive drum 61A, with a predetermined spacing distance, so that the electric charger 61B is arranged, to some extent, near to a lower rear portion of the photoconductive drum 61A.

The developing roller 61C is a member which holds the toner (developing agent) and which supplies the toner to an electrostatic latent image formed on the photoconductive drum 61A, and the developing roller 61C is arranged, to some extent, near to a lower front portion of the photoconductive drum 61A. The supplying roller 61D is a member which supplies the toner to the developing roller 61C, and is arranged, to some extent, near to a lower front portion of the developing roller 61C. The layer-thickness regulating blade 61E is a member which regulates the thickness of the tonner held on the developing roller 61C, and is arranged to contact with a rear portion of the developing roller 61C.

Returning to FIG. 1 again, the transferring section 70 is arranged at a position above the processing section 60. The transferring section 70 is provided with a driving roller 71; a driven roller 72; and an intermediate transferring belt 73 which is formed of an endless belt and which is arranged to be stretched between the driving roller 71 and the driven roller 72 so as to face the respective photoconductive drums 61A; four pieces of a primary transferring roller 74 which are arranged to face the photoconductive drums 61A, respectively, so that the intermediate transferring belt 73 is pinched between the primary transferring rollers 74 and the photoconductive drums 61A; and a secondary transferring roller 75 which is arranged to face the driving roller 71 so that the intermediate transferring belt 73 is pinched between the secondary transferring roller 75 and the driving roller 71.

The fixing section 80 is arranged in the body housing 10 at a position above a rear portion of the transferring section 70, and is mainly provided with a heating roller 81 and a pressure roller 82 which is arranged facing the heating roller 81 and which presses the heating roller 81.

In the image forming section 40, the surface of each of the photoconductive drums 61A is uniformly charged by the electric charger 61B, and then is exposed by the high-speed scanning with the laser light from the exposure section 50. With this, an electrostatic latent image based on an image data is formed on each of the photoconductive drums 61A. Further, the tonner inside each of the process cartridges 61 is supplied to the developing roller 61C via the supplying roller 61D, and enters between the developing roller 61C and the layer-thickness regulating blade 61E so that the tonner is held on the developing roller 61C as a thin layer having a constant thickness.

The tonner held on the developing roller 61C is supplied from the developing roller 61C to the electrostatic latent image on the photoconductive drum 61A. With this, the electrostatic latent image is visualized (made as a visual image), and a toner image (image) is formed on the photoconductive drum 61A.

The toner images of respective colors formed on the photoconductive drums 61A, respectively, are transferred onto the intermediate transferring belt 73 while being sequentially overlaid on top of one another. Then, paper P transported from the paper feeding section 30 is made to pass between the intermediate transferring belt 73 and the secondary transferring roller 75, thereby transferring the overlaid tonner images formed on the intermediate transferring belt 73 onto the paper P. Afterwards, the paper P onto which the toner images are transferred is transported between the heating roller 81 and the pressure roller 82, thereby thermally fixing, on the paper P, the tonner images transferred onto the paper P. Then, the paper P, on which the tonner images are transferred and thermally fixed, is discharged by a paper discharging roller 83 to a discharged paper tray 12 provided on an upper portion of the body housing 10.

Detailed Configuration of Process Cartridge

Next, an explanation will be given about the detailed configuration of the process cartridge 61. As shown in FIG. 2, each of the process cartridges 61 is provided with a developing chamber 100 in which the developing roller 61C and the supplying roller 61D are disposed; a first tonner-accommodating chamber 200 (first developing agent-accommodating chamber) which is adjacent to a lower portion of the developing chamber 100; and a second tonner-accommodating chamber 300 (second developing agent-accommodating chamber) which is adjacent to an obliquely lower front portion of the developing chamber 100 and which is adjacent to an obliquely upper front portion of the first toner-accommodating chamber 200. The position of the first toner-accommodating chamber 200 is arranged at the same side (rear side) as the developing chamber 100 with respect to the second toner-accommodating chamber 300, as viewed from above or below the process cartridge 61. Further, the developing chamber 100, the second toner-accommodating chamber 300 and the first toner-accommodating chamber 200 are arranged so that the arrangement positions in the up/down direction (vertical direction) of the developing chamber 100, the second toner-accommodating chamber 300 and the first toner-accommodating chamber 200 are lowered sequentially in an order of the developing chamber 100, the second toner-accommodating chamber 300 and the first toner-accommodating chamber 200.

Configuration of Developing Chamber

The developing chamber 100 has a circular-arc wall 101 which has a circular-arc shaped cross section and which is provided at a position below the supplying roller 61D and along the supplying roller 61D; and an upper wall 102 which is arranged in front of the developing roller 61C and which extends substantially in the front/rear direction. The circular-arc wall 101 has a front side surface 101A at which the circular-arc wall 101 faces the second toner-accommodating chamber 300, and a supply port 103 which is defined between the upper end portion of the front side surface 101A and the upper wall 102 and which communicates the developing chamber 100 and the second toner-accommodating chamber 300 with each other. It is possible to store or retain the toner in a space defined by the circular-arc wall 101 inside the developing chamber 100.

Configuration of First Toner-Accommodating Chamber

The first toner-accommodating chamber 200 is formed to have substantially a hollow circular-cylindrical shape, and is communicated with the second toner-accommodating chamber 300 at the obliquely upper front portion thereof. The toner is accommodated inside the first toner-accommodating chamber 200, and a first agitator 210 as an example of the first rotating member is provided inside the first toner-accommodating chamber 200.

The first agitator 210 is mainly constructed of a first rotation shaft 211 which is supported rotatably by the left and right side walls of the first toner-accommodating chamber 200, a first support portion 212 which extends outwardly from the first rotating shaft 211 in the radial direction, and a first agitating wing 213 which is elastically deformable and which is fixed to the first support portion 212. Such a first agitator 210 rotates in the first toner-accommodating chamber 200 (in counterclockwise direction shown in the drawing). At this time, the first agitating wing 213 rotates so as to slidably contact with the inner wall of the first toner-accommodating chamber 200, thereby agitating the toner and performing function of transporting the toner toward a communication port 313 (see FIGS. 3 to 8; to be described later on).

Configuration of Second Toner-Accommodating Chamber

The second toner-accommodating chamber 300 is constructed of an upper wall 301, a wall 302 of which cross section is circular-arc shaped and of which front portion is curved upwardly, and a film 310 (elastic plate). The upper wall 301 extends from the wall 302 in the obliquely rearward and upward direction and is continued to the upper wall 102 of the developing chamber 100. The volume of the second toner-accommodating chamber 300 is small as compared with the volume of the first toner-accommodating chamber 200.

The film 310 is an elastic member which is deflectably deformable and is formed of a resin such as polyethylene terephthalate, etc.; the film 310 is formed so that an end portion 311 of the film 310 is supported by a lower portion of the wall 302 of the second toner-accommodating chamber 300, and that the other end portion 312 of the film 310 extends toward the front side surface 101A of the circular-arc wall 101 of the developing chamber 100 (extends in the obliquely rearward and upward direction). A communication port 313 is defined between the other end portion 312 and the front side surface 101A of the circular-arc wall 101; the second toner-accommodating chamber 300 and the first toner-accommodating chamber 200 are communicated with each other via the communication port 313. Further, it is possible to store the toner with the wall portion 302 and the film 310 of the second toner-accommodating chamber 300.

A second agitator 320 as an example of the second rotating member is provided inside the second toner-accommodating chamber 300. The second agitator 320 is mainly constructed of a second rotation shaft 321 which is supported rotatably by the left and right side walls of the second toner-accommodating chamber 300, a second support portion 322 which extends outwardly from the second rotating shaft 321 in the radial direction, and a second agitating wing 323 which is elastically deformable and which is fixed to the second support portion 322. Such a second agitator 320 rotates in the second toner-accommodating chamber 300 (in clockwise direction shown in the drawing). At this time, the second agitating wing 323 rotates so as to slidably contact with the inner wall of the second toner-accommodating chamber 300, thereby agitating the toner and performing function of transporting the toner toward the supply port 103.

Detailed Explanation on Toner Transporting Operation

Figure 3:
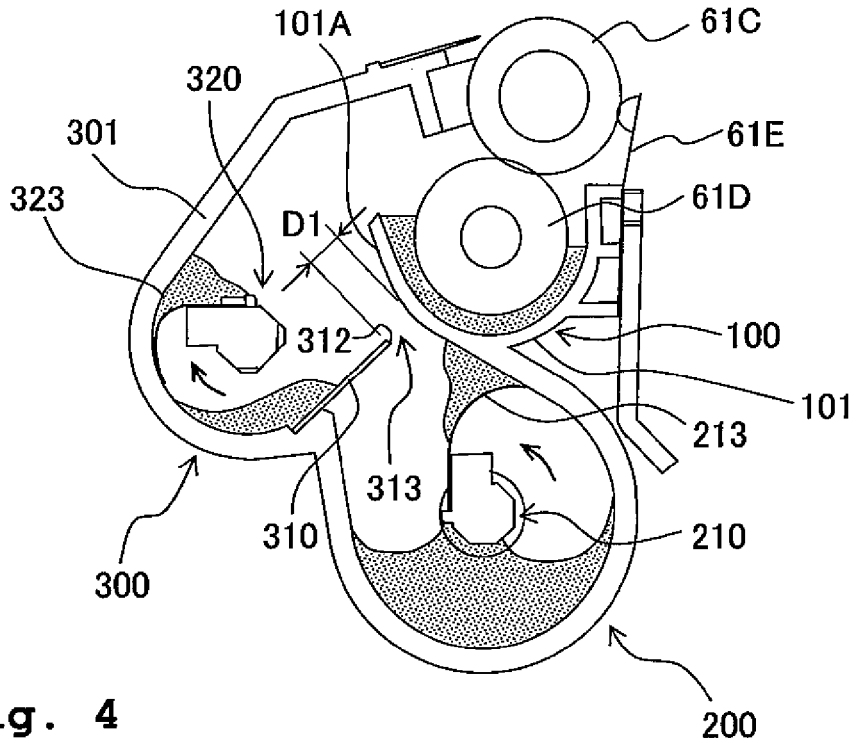
FIG. 3 is a view showing a state that a first rotating member lifts or carries upward the developing agent.

An explanation will be given about the operations of the first and second agitators 210 and 320, with reference to FIGS. 3 to 8. First, an explanation will be given about the operation of the first agitator 210. The first agitator 210 lifts the toner upward as shown in FIG. 3, and when the first agitating wing 213 separates from the inner wall of the first toner-accommodating chamber 200, the toner is flown toward the communication port 313. At this point of time, the film 310 is not deflectably deformed (is in a normal state), and the spacing distance between the other end portion 312 of the film 310 and the front side surface 101A of the circular-arc wall 101 is "D1" (see FIG. 3).

Figure 4:
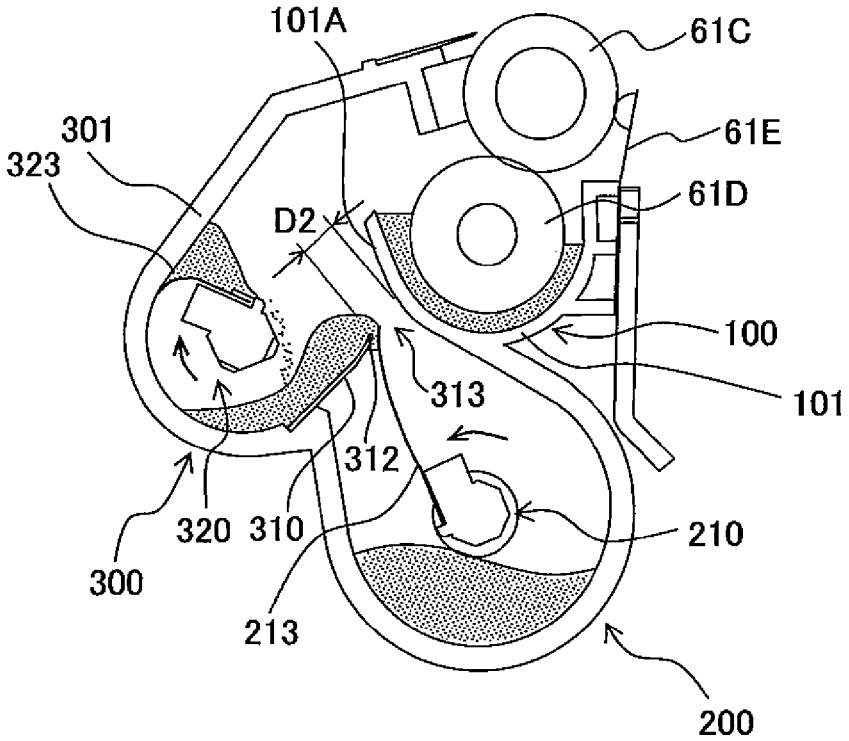
FIG. 4 is a view showing a state that the developing agent is being supplied to a second developing agent-accommodating chamber by the first rotating member.
Figure 5:
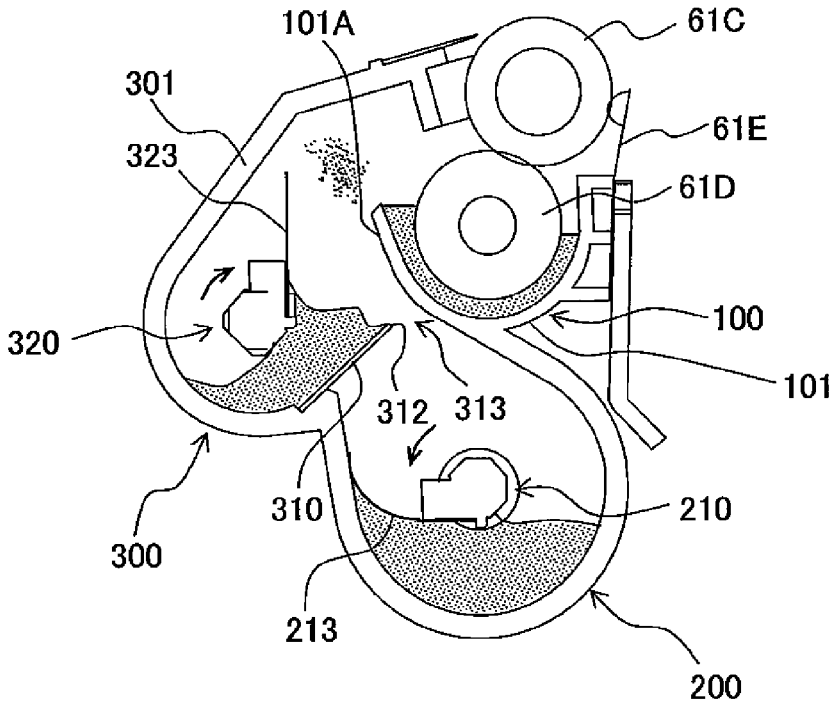
FIG. 5 is a view showing a state that a second rotating member is supplying the developing agent toward a developing section.

Further, as shown in FIG. 4, when the first agitator 210 rotates, the first agitator 210 makes contact with the film 310 with the toner intervening therebetween, and the film 310 is deflected (deformed) toward the second toner-accommodating chamber 300. With this, the spacing distance between the other end portion 312 of the film 310 and the front side surface 101A of the circular-arc wall 101 is increased to be "D2" (see FIG. 4). In other words, the first agitator 210 causes the film 310 to deflected (deformed) via the toner to thereby increase the width of the communication port 313 to be greater than when the film 310 is in the normal state. Accordingly, the toner flown by the first agitator 210 is supplied to the second toner-accommodating chamber 300 from the communication port 313 with the widened width in such a manner. Then, the first agitator 210 has ceased to contact with the film 310 as shown in FIG. 5, and the film 310 is returned to the normal state. The first agitator 210 further continues to rotate, agitates the toner inside the first toner-accommodating chamber 200 (see FIGS. 6 to 8), and repeats the operations starting from FIG. 3.

Next, an explanation will be given about the operation of the second agitator 320. The second agitator 320 rotates to thereby upwardly lift the toner inside the second toner-accommodating chamber 300 (see FIGS. 3 and 4). Then, as shown in FIG. 5, when the second agitator 320 is oriented upwardly (when the posture of the second agitating wing 323 is upward), the toner is released toward the supply port 103. The released toner flies along the upper wall 301, of the second toner accommodating chamber 300, which is inclined toward the supply port 103; and the toner is supplied to the inside of a space defined by the circular-arc wall 101 of the developing chamber 100. Any excessive toner which cannot be fully held inside the developing chamber 100 falls down from the upper end portion of the front side surface 101A of the circular-arc wall 101, and returns to the second toner-accommodating chamber 300.

Figure 6:
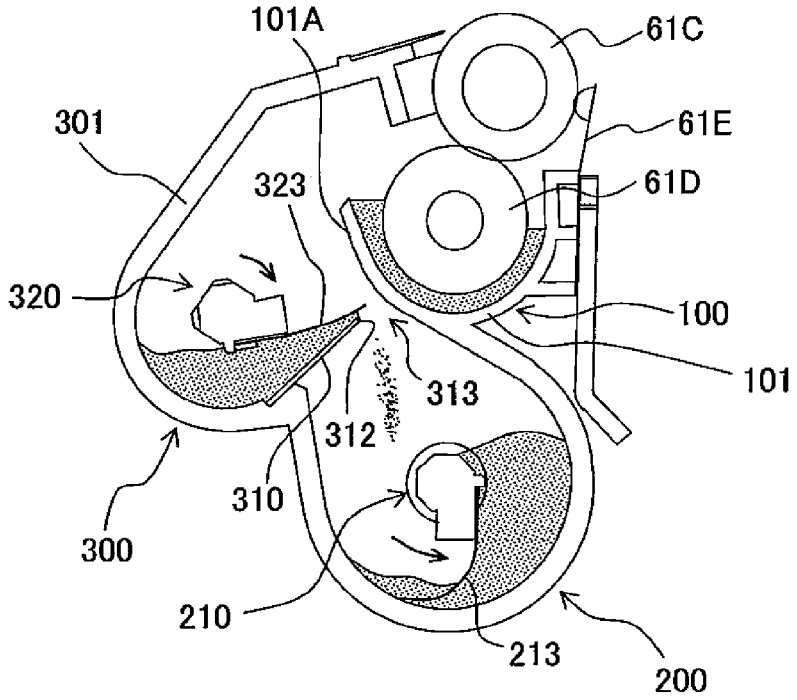
FIG. 6 is a view showing a state that the second rotating member makes contact with an elastic plate.
Figure 7:
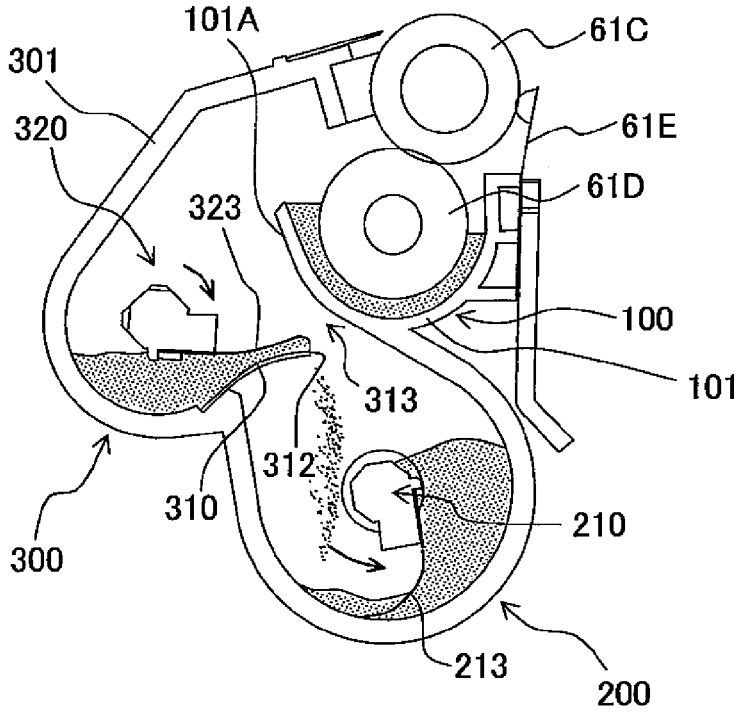
FIG. 7 shows a state that the second rotating member makes contact with the elastic plate to thereby deflectably deform the elastic plate downwardly, whereupon the developing agent falls down to the first developing agent-accommodating chamber.
Figure 8:
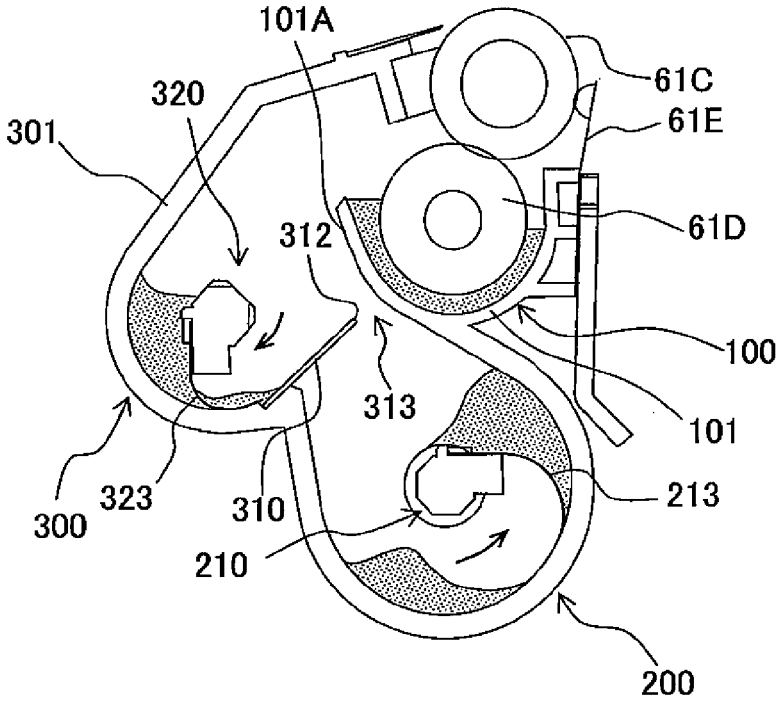
FIG. 8 shows a state that the elastic plate is returned to the original position thereof from the state shown in FIG. 7.

When the second agitator 320 further rotates and, as shown in FIGS. 6 and 7, the second agitator 320 makes contact with the film 310 with the toner intervening therebetween, then the film 310 is deflected (deformed) toward the first toner-accommodating chamber 200. With this, the toner inside the second toner-accommodating chamber 300 falls down to the first toner-accommodating chamber 200. Further, as shown in FIG. 8, when the second agitator 320 is removed away from the film 310 (has ceased to contact with the film 310), the film 310 returns to the normal state. After that, the film 310 is deflected toward the second toner-accommodating chamber 300 again as shown in FIG. 4, when the first agitator 210 makes contact with the film 310. By repeating the operations shown in FIGS. 3 to 8 in such a manner, the film 310 is alternately deflected toward the first toner-accommodating chamber 200 and toward the second toner-accommodating chamber 300, and the toner is circulated between the first toner-accommodating chamber 200 and the second toner-accommodating chamber 300.

In the process cartridge 61 constructed as described above, the second toner-accommodating chamber 300 is provided separately from the first toner-accommodating chamber 200, at a position lower than the position of the developing chamber 100. Therefore, the first agitator 210 may only have to transport the toner to the second toner-accommodating chamber 300 which is located at the position lower than the position of the developing chamber 100, thereby making it possible to reduce the burden exerted on the first agitator 210 when transporting the toner, as compared with such a case of transporting the tonner directly to the developing chamber 100. Further, the second toner-accommodating chamber 300 is arranged at an obliquely frontward and upward position with respect to the first toner-accommodating chamber 200, and thus the distance from the second tonner accommodating chamber 300 to the developing chamber 100 is short. Accordingly, also regarding the second agitator 320, it is possible to reduce the burden during the toner transportation. Owing to the configuration as described above, it is allowable that the transporting performance of each of the first and second agitators 210 and 320 is made to be small, and thus the burden can be reduced. Accordingly, it is possible to reduce the degradation of the first and second agitators 210 and 320. With this, it is possible to transport the toner to the developing chamber 100 in a stable manner.

Further, since the volume of the second toner-accommodating chamber 300 is smaller than the volume of the first toner-accommodating chamber 200, the second agitator 320 may be made smaller than the first agitator 210. With this, the transporting amount of the toner by the second agitator 320 can be made small, and thus the burden exerted on the second agitator 320 can be reduced. Accordingly, it is possible to suppress the degradation of the second agitator 320 and to supply the toner to the developing chamber 100 in a stable manner.

Furthermore, the developing chamber 100, the second toner-accommodating chamber 300 and the first toner-accommodating chamber 200 are arranged so that positions of the developing chamber 100, the second toner-accommodating chamber 300 and the first toner-accommodating chamber 200 in the up/down direction are lowered sequentially in an order of the developing chamber 100, the second toner-accommodating chamber 300 and the first toner-accommodating chamber 200. Further, the position of the first toner-accommodating chamber 200 is on the same side as the developing chamber 100 with respect to the second toner-accommodating chamber 300, as viewed from above and below the process cartridge 61. With this, it is possible to reduce any useless space in the process cartridge 61, and thus to make the size of the process cartridge 61 as a whole to be small. Moreover, since the first toner-accommodating chamber 200 is arranged at a position below and adjacent to the developing chamber 100, the process cartridge 61 can thus be made to be further small as a whole.

Further, in the process cartridge 61 of the embodiment, the film 310 is provided on the wall 302 of the second toner-accommodating chamber 300. Accordingly, for example, when the first agitator 210 makes contact with the film 310, the film 310 is deflected (deformed) toward the second toner-accommodating chamber 300, thereby increasing the width of the communication port 313. This makes the toner flown by the first agitator 210 be easily supplied to the inside of the second toner-accommodating chamber 300, and thus the toner can be supplied to the second toner-accommodating chamber 300 in a stable manner. On the other hand, when the second agitator 320 and the film 310 make contact with each other, the film 310 is deflected (deformed) toward the first toner-accommodating chamber 200, thereby making it possible to return the toner inside the second toner-accommodating chamber 300 to the first toner-accommodating chamber 200; and by causing the second agitator 320 to continuously rotate, these operations are performed repeatedly. With this, the toner can be circulated satisfactorily between the first and second toner-accommodating chambers 200 and 300.

Although the embodiment of the present teaching has been explained as described above, the present teaching is not limited only to the above-described embodiment. Specific configuration of the present teaching can be changed or modified as appropriate, without departing from the spirit or scope of the present teaching.

In the above-described embodiment, for example, an elastic member made of a resin such as polyethylene terephthalate, etc. is used as the film 310. It is allowable, however, to use another elastic member provided that the another elastic member is deflectably deformable.

In the embodiment, although two developing agent-accommodating chambers that are the first and second toner-accommodating chambers 200 and 300 are provided in the configuration of the embodiment, the present teaching is not limited only to this. It is allowable to provide, for example, three developing agent-accommodating chambers in the configuration of the embodiment.

In the embodiment, although the developing chamber 100, the first toner-accommodating chamber 200 and the second toner-accommodating chamber 300 are configured as an integrated body, the present teaching is not limited to this. It is allowable to configure that the first and second toner-accommodating chambers 200 and 300 are detachable with respect to the developing chamber 100.

Although in the embodiment, the developing device of the present teaching is exemplified by the process cartridge 61, there is no limitation to this. It is allowable for example to use a developing cartridge, which is detachable with respect to a drum cartridge, as the developing device.

Although in the embodiment, the image forming apparatus provided with the developing device of the present teaching is exemplified by the color multi-functioned machine 1, there is no limitation to this. For example, the image forming apparatus may be a copying machine, printer, and the like.

What is claimed is:

1. A developing device comprising:

a developing chamber provided with a developing agent-holding body rotatable around a first rotation axis extending in a first direction and configured to hold a developing agent, and a supplying roller rotatable around a second rotation axis extending in the first direction and configured to supply the developing agent to the developing agent-holding body;

a first developing agent-accommodating chamber configured to accommodate the developing agent and arranged at a position below the developing chamber;

a first rotating member disposed in the first developing agent-accommodating chamber, comprising a first shaft extending in the first direction and a first wing connected to the first shaft and elastically deformable, and configured to rotate so that the first wing slidably contacts with an inner surface of the first developing agent-accommodating chamber;

a second developing agent-accommodating chamber which is arranged adjacent to the developing chamber and adjacent to an upper portion of the first developing agent-accommodating chamber, and to which the developing agent in the first developing agent-accommodating chamber is supplied by rotation of the first rotating member; and a second rotating member disposed in the second developing agent-accommodating chamber, comprising a second shaft extending in the first direction and a second wing connected to the second shaft and elastically deformable, and configured to rotate so that the second wing slidably contacts with an inner surface of the second developing agent-accommodating chamber and to transport the developing agent in the second developing agent-accommodating chamber toward the developing chamber;

wherein the first rotating member is disposed so that a virtual vertical surface including the second rotation axis of the supplying roller intersects a rotation trajectory of the first wing of the first rotating member;

wherein the second rotating member is disposed so that the second shaft of the second rotating member is positioned above the first shaft of the first rotating member and below the second rotation axis of the supplying roller in a vertical direction; and wherein the second rotating member is disposed so that the second shaft of the second rotating member is positioned on a side opposite to the first rotation axis of the developing agent-holding body with respect to the virtual vertical surface including the second rotation axis of the supplying roller.

2. The developing device according to claim 1, wherein a volume of the second developing agent-accommodating chamber is smaller than a volume of the first developing agent-accommodating chamber.

3. The developing device according to claim 1, wherein the developing chamber, the second developing agent-accommodating chamber and the first developing agent-accommodating chamber are arranged so that positions in a vertical direction of the developing chamber, the second developing agent-accommodating chamber and the first developing agent-accommodating chamber are lowered sequentially in an order of the developing chamber, the second developing agent-accommodating chamber and the first developing agent-accommodating chamber.

4. The developing device according to claim 3, wherein the first developing agent-accommodating chamber is arranged on a same side as the developing chamber with respect to the second developing agent-accommodating chamber, as viewed from the vertical direction.

5. The developing device according to claim 1, further comprising an elastic plate configured to be deflectably deformable, one end portion of the elastic plate being supported by a lower wall portion of the second developing agent-accommodating chamber, wherein the elastic plate is supported by the one end portion so that another end portion of the elastic plate is located at a position above the one end portion.

6. The developing device according to claim 1, wherein the first developing agent-accommodating chamber is adjacent to a lower portion of the developing chamber.

7. A developing device comprising:

a developing agent-holding body rotatable around a first rotation axis extending in a first direction and configured to hold a developing agent;

a housing provided with:

a developing chamber configured to accommodate the developing agent-holding body, and a supplying roller rotatable around a second rotation axis extending in the first direction and configured to supply the developing agent to the developing agent-holding body;

a first developing agent-accommodating chamber configured to accommodate the developing agent and arranged at a position below the developing chamber; and a second developing agent-accommodating chamber which is arranged adjacent to the developing chamber and adjacent to an upper portion of the first developing agent-accommodating chamber;

a first rotating member comprising a first shaft extending in the first direction and a first wing connected to the first shaft and elastically deformable, and configured to rotate so that the first wing slidably contacts with an inner surface of the first developing agent-accommodating chamber and to supply the developing agent to the second developing agent-accommodating chamber; and a second rotating member comprising a second shaft extending in the first direction and a second wing connected to the second shaft and elastically deformable, and configured to rotate so that the second wing slidably contacts with an inner surface of the second developing agent-accommodating chamber and to transport the developing agent in the second developing agent-accommodating chamber toward the developing chamber;

wherein the first rotating member is disposed so that a virtual vertical surface including the second rotation axis of the supplying roller intersects a rotation trajectory of the first wing of the first rotating member;

wherein the second rotating member is disposed so that the second shaft of the second rotating member is positioned above the first shaft of the first rotating member and below the second rotation axis of the supplying roller in a vertical direction; and wherein the second rotating member is disposed so that the second shaft of the second rotating member is positioned on a side opposite to the first rotation axis of the developing agent-holding body with respect to the virtual vertical surface including the second rotation axis of the supplying roller.

8. The developing device according to claim 7, wherein a volume of the second developing agent-accommodating chamber is smaller than a volume of the first developing agent-accommodating chamber.

9. The developing device according to claim 7, wherein the developing chamber, the second developing agent-accommodating chamber and the first developing agent-accommodating chamber are arranged so that positions in a vertical direction of the developing chamber, the second developing agent-accommodating chamber and the first developing agent-accommodating chamber are lowered sequentially in an order of the developing chamber, the second developing agent-accommodating chamber and the first developing agent-accommodating chamber.

10. The developing device according to claim 9, wherein the first developing agent-accommodating chamber is arranged on a same side as the developing chamber with respect to the second developing agent-accommodating chamber, as viewed from the vertical direction.

11. The developing device according to claim 7, further comprising an elastic plate configured to be deflectably deformable, one end portion of the elastic plate being supported by a lower wall portion of the second developing agent-accommodating chamber, wherein the elastic plate is supported by the one end portion so that another end portion of the elastic plate is located at a position above the one end portion.

12. The developing device according to claim 7, wherein the first developing agent-accommodating chamber is adjacent to a lower portion of the developing chamber.

13. A developing device, comprising:

a housing configured to accommodate a developing agent;

a developing roller rotatable around a first rotation axis extending in a first direction and configured to hold a developing agent;

a supplying roller rotatable around a second rotation axis extending in the first direction and configured to supply the developing agent to the developing roller;

a first agitator comprising a first shaft extending in the first direction and a first wing connected to and rotatable around the first shaft, configured to transport the developing agent, and disposed so that a virtual vertical surface including the second rotation axis of the supplying roller intersects a rotation trajectory of the first wing of the first agitator; and a second agitator comprising a second shaft extending in the first direction and a second wing connected to and rotatable around the second shaft, configured to transport the developing agent transported by the first agitator to the supplying roller, and disposed so that the second shaft is positioned above the first shaft of the first agitator in a vertical direction and on a side opposite to the first rotation axis of the developing roller with respect to the virtual vertical surface including the second rotation axis of the supplying roller.

14. The developing device according to claim 13, wherein the housing is provided with a first accommodating chamber configured to accommodate the first agitator and a second accommodating chamber configured to accommodate the second agitator, and wherein a lowermost portion of the second accommodating chamber is positioned above a lowermost portion of the first accommodating chamber in the vertical direction.

15. The developing device according to claim 14, wherein the housing is further provided with a developing chamber configured to accommodate the developing roller and a supplying roller, and wherein a lowermost portion of the developing chamber is positioned above the lowermost portion of the second accommodating chamber in the vertical direction.

16. The developing device according to claim 13, wherein the housing is provided with a first accommodating chamber configured to accommodate the first agitator and a second accommodating chamber configured to accommodate the second agitator, and wherein a lowermost portion of the second accommodating chamber is positioned above the first shaft of the first agitator in the vertical direction.

17. The developing device according to claim 16, wherein the housing is further provided with a developing chamber configured to accommodate the developing roller and a supplying roller, and wherein a lowermost portion of the developing chamber is positioned above the lowermost portion of the second accommodating chamber in the vertical direction.

18. The developing device according to claim 13, wherein the housing is provided with a first accommodating chamber configured to accommodate the first agitator and a second accommodating chamber configured to accommodate the second agitator, and wherein a partitioning member is provided between the first accommodating chamber and the second accommodating chamber.

19. The developing device according to claim 18, wherein the partitioning member is an elastic member.

20. The developing device according to claim 19, wherein the elastic member is a film.

* * * * *